US007622019B2

(12) United States Patent
You et al.

(10) Patent No.: US 7,622,019 B2
(45) Date of Patent: Nov. 24, 2009

(54) **PULP AND PAPER MADE FROM *RHODOPHYTA* AND MANUFACTURING METHOD THEREOF**

(75) Inventors: Hack-Churl You, 209, Gyeonghwa-dong 3-Ga, Jinhae 645-270 (KR); Jun-Hyuk Park, Seoul (KR)

(73) Assignee: Hack-Churl You, Seoul (KR)

( * ) Notice: Subject to any disclaimer, the term of this patent is extended or adjusted under 35 U.S.C. 154(b) by 400 days.

(21) Appl. No.: 10/578,281

(22) PCT Filed: Nov. 12, 2004

(86) PCT No.: PCT/KR2004/002939

§ 371 (c)(1), (2), (4) Date: Feb. 2, 2007

(87) PCT Pub. No.: WO2005/047598

PCT Pub. Date: May 26, 2005

(65) Prior Publication Data

US 2008/0057547 A1 Mar. 6, 2008

(30) Foreign Application Priority Data

Nov. 13, 2003 (KR) ..... 10 2003 0080330
Nov. 12, 2004 (KR) ..... 10 2004 0092297

(51) Int. Cl.
*D01C 1/00* (2006.01)

(52) U.S. Cl. ..... 162/99; 435/278

(58) Field of Classification Search ..... 162/99; 435/278

See application file for complete search history.

(56) References Cited

U.S. PATENT DOCUMENTS 5,472,569 A * 12/1995 Nicolucci et al. ..... 162/99
5,496,936 A * 3/1996 Thami et al. ..... 536/124
5,500,086 A 3/1996 Sakai et al.

FOREIGN PATENT DOCUMENTS

| | | | |
|---|---|---|---|
| JP | 54-038901 | | 3/1979 |
| JP | 61-063800 | | 4/1986 |
| JP | 63-243399 | | 10/1988 |
| JP | 63-243400 | | 10/1988 |
| JP | 03-199486 | | 8/1991 |
| JP | 3-199486 | A | 8/1991 |
| JP | 04-202892 | | 7/1992 |
| JP | 4-202892 | A | 7/1992 |
| JP | 7-304881 | A | 11/1995 |
| JP | 07-305294 | | 11/1995 |
| JP | 2000-245403 | | 9/2000 |
| JP | 2002-125485 | A | 5/2002 |

OTHER PUBLICATIONS

International Search Report of corresponding PCT International Application No. PCT/KR2004/002939; dated Feb. 21, 2005 (2 pages).

* cited by examiner

*Primary Examiner*—Sandra Saucier
*Assistant Examiner*—Susan Hanley
(74) *Attorney, Agent, or Firm*—Locke Lord Bissell & Liddell LLP

(57) ABSTRACT

Disclosed is a method of manufacturing pulp and paper using Rhodophyta, including immersing Rhodophyta in an extraction solvent able to dissolve agar gel for a predetermined time period to dissolve the agar gel in the extraction solvent, reacting the dissolved agar gel with a reaction solvent to be converted into a fiber, curing the fiber using a curing agent, and pulping the cured fiber. The method of the current invention is advantageous because of lower manufacturing costs, due to eliminating the need to purchase wood. Further, the use of chemicals for lignin removal and bleaching drastically decreases, thus preventing environmental contamination. Furthermore, since a final product does not contain harmful chemicals, humans and the environment are not negatively affected.

18 Claims, 2 Drawing Sheets

PULP AND PAPER MADE FROM *RHODOPHYTA* AND MANUFACTURING METHOD THEREOF

This application is the national phase application under 35 U.S.C. §371of International Application No. PCT/KR2004/002939 filed on Nov. 12, 2004 entitled, "PULP AND PAPER MADE FROM RHODOPHYTA AND MANUFACTURING METHOD THEREOF" which claims the benefit of Korean Patent Application No. 10-2003-0080330 filed on Nov. 13, 2003 and 10-2004-0092297 filed Nov. 12, 2004.

TECHNICAL FIELD

The present invention relates, in general, to pulp and paper, and a manufacturing method thereof and, more particularly, to pulp and paper resulting from using Rhodophyta, instead of wood, as a pulp and paper material, and a method of manufacturing the same.

BACKGROUND ART

Generally, fiber obtained by mechanically or chemically treating plant material is referred to as pulp. The pulp material includes cotton, hemp, linen, jute, ramie, Manila hemp, *Edgeworthia papyrifera* tree fiber, paper mulberry fiber, straw, esparto grass, bamboo fiber, and bagasse, as well as wood. In addition, requirements for industrial material include abundant quantity, easy collection, transportation and storage, low price and excellent quality.

Wood, as a main pulp material, is composed of cellulose, hemicellulose and lignin. These components constitute a cell wall and an intercellular layer, and constitute 90% or more of all trees. Minor components include extracts, such as resin, refined oil, oil fat, tannin and flavonoid, and other inorganic compounds. Among these components, cellulose is present in the largest amount among the natural organic materials, and mainly constitutes the cell wall of the plant. Cellulose is insoluble in water, diluted acid and alkali at room temperature, and is a polymer material having D-glucose subunits linked by β-1:4-glucoside bond. For industrial application, wood cellulose is subjected to processes of beating, bleaching and purifying to manufacture paper, or the wood may be hydrolyzed to be used as wood sugar. Otherwise, the wood cellulose may be formed into cellulose derivatives through various chemical treatments.

A variety of processes are performed to obtain the pulp from the pulp material, which include preparation of the pulp material, pulping, and purifying of the pulp. To easily pulp the wood material, the processes of cutting, barking and sorting are carried out according to the kind of the pulp material. The process of obtaining the fiber from the prepared pulp material is referred to as pulping, which is the most important process in the pulp manufacture.

With the aim of forming the fiber, a composite intercellular layer of the pulpwood is broken using a wood pulp grinder, or is softened using water vapor and then broken by physical force. Pulp obtained through simple mechanical treatment without chemical treatment is called mechanical pulp. Mechanical pulp is advantageous because of a high yield and low manufacturing costs, but unsuitable for use as high quality paper stock because of a high lignin content Treatment of the pulp material using a chemical for lignin removal results in the composite intercellular layer being dissolved and thus dissociated into a fibrous material. The pulp obtained in such a method is called chemical pulp. Upon manufacturing the chemical pulp, the bulk of lignin of the cell membrane as well as lignin present in the intercellular layer of the pulp material is removed. Simultaneously, large amounts of hemicellulose are dissolved, and a small amount of cellulose is decomposed. Although chemical pulp is high quality, that is, it has highly pure cellulose, it has a lower yield and higher manufacturing costs compared with mechanical pulp. The chemical pulp manufacturing method is exemplified by sulfite pulping, soda pulping, sulfate pulping, etc.

The cleaning process functions to remove non-pulped portion and impurities from the pulped fiber by washing and sorting. Then, as necessary, the bleaching process may be performed. In addition, to obtain high quality rayon pulp, a specific purifying process is carried out.

The above descriptions concern the general pulp manufacturing process using pulpwood. However, according to increasing wood exhaustion over the world, producing paper pulp while protecting the forest and environment is a problem awaiting a solution in the related art. To overcome the problem, techniques of manufacturing paper pulp from non-wood plant fibers mainly by using one- or two-year-old plants have been proposed.

Non-wood plants usable as the pulp material include, for example, bast fiber of paper mulberry, linen, hemp, cotton plants, Manila hemp, rice straw, bagasse, etc. In general, non-wood plants have a large amount of pectin, hemicellulose and inorganic materials and a small amount of lignin. Upon pulping, non-wood plants are subjected to chemical pulping, semi-chemical or mechanochemical pulping, and can be formed into unbleached or bleached pulp under milder conditions, unlike wood.

Non-wood pulp has different properties according to fiber forms, chemical compositions, non-fiber cell types and amounts. Therefore, the paper made using the non-wood pulp alone or in combination with the wood pulp can be easily controlled in terms of strength, durability, electric properties, gloss, dimensional stability and printability, and thus, be used as various applications, with wide use ranges.

However, to manufacture chemical pulp for paper using non-wood plant fiber, a process of soda pulping, sulfite pulping or kraft pulping is mainly adopted. Upon manufacturing pulp, a large amount of a sulfur compound, such as $Na_2SO_3$ or $Na_2S$, as a beating agent is used in the sulfite and kraft processes. This compound generates offensive smells and aggravates wastewater. As a sulfur-free pulping method, there is proposed a beating process using soda. However, the use of soda alone results in low pulp yield and low paper strength. To alleviate the problems, the use of anthraquinone along with soda has been proposed, but anthraquinone has difficulties in preparation of the beating agent and in biodegradation thereof. Further, anthraquinone is expensive, thus increasing the manufacturing costs of the non-wood pulp.

In this regard, Korean Patent Laid-open Publication No. 2001-1550 discloses a method of manufacturing pulp using corn as herbaceous plant. By using the corn stem as paper pulp material, it is possible to make paper having high quality like Korean paper, with low manufacturing costs.

However, the above method is disadvantageous because it uses a toxic chemical, thus causing environmental contamination Japanese Patent Laid-open Publication No. Hei. 3-199486 discloses a method of manufacturing paper and binder fiber using a water-soluble polysaccharide. The usable water-soluble polysaccharide includes agar, carrageenan, alginic acid, etc. The above method is characterized in that an aqueous solution of water-soluble polysaccharide is added to a solvent having hydrophilicity while being poorly soluble to the water-soluble polysaccharide, to obtain a fibrous precipitate. Such a precipitate is applied in the fields of edible packaging for foods and medicines. However, since the film material is obtained by practically using the method as described above, it is impossible for the film material to be of practical use as a paper.

In addition, Korean Patent Laid-open Publication No. 1999-34085 discloses a method of manufacturing a film as a substitute for cellophane, using a carrageenan biopolymer. The invention discloses that carrageenan, which is extracted under mild conditions and has excellent film-forming properties, can be substituted for the plastic cellophane material that generates environmental wastes. However, as a result of actual experiments by the present inventors, the resultant film is very low in strength and cannot be used in practical applications. That is, an additional process using an additive is required.

EXPLANATION OF REFERENCE NUMERALS FOR MAJOR PORTIONS SHOWN IN DRAWINGS

Figure 1:
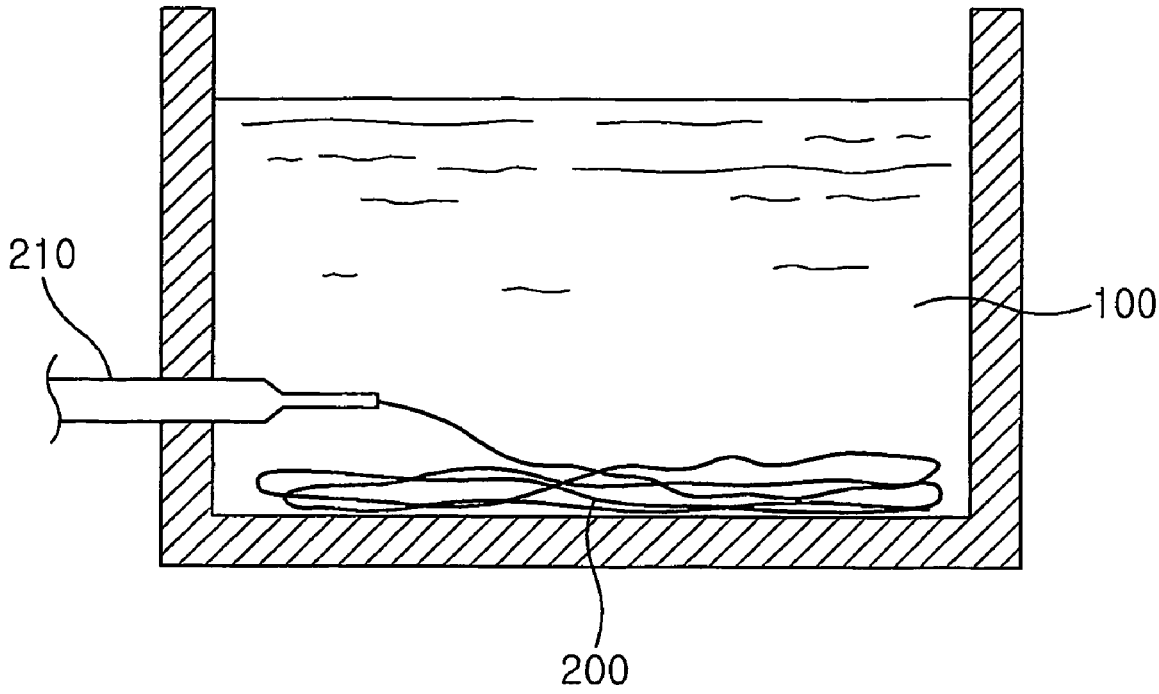
FIG. 1 is a view showing a process of adding a gel solution to a reaction solvent using an extrusion nozzle.

| | |
|---|---|
| 100: reaction solvent | 200: gel solution |
| 210: extrusion nozzle | 220: spray nozzle |

Disclosure

Technical Problem

The present invention is conceived to solve the aforementioned problems in the prior art. An object of the present invention is to provide pulp and paper and a manufacturing method thereof, capable of preventing environmental contamination and protecting forests and not using a toxic chemical during beating or bleaching.

Another object of the present invention is to provide pulp and paper which is manufactured with waste from pulp material minimized and a manufacturing method thereof.

Technical Solution

In order to accomplish the above objects, according to the present invention, a method of manufacturing pulp using Rhodophytais provided, the method comprising: immersing Rhodophyta in an extraction solvent able to dissolve agar gel for a predetermined time period to dissolve the agar gel in the extraction solvent; converting the dissolved agar gel into a fiber by reacting the dissolved agar gel with a reaction solvent; curing the fiber using a curing agent; and pulping the cured fiber.

The conversion into the fiber may be performed by continuously extruding the agar gel solution into the reaction solvent using an extrusion nozzle, or by intermittently extruding the agar gel solution into the reaction solvent using a spray nozzle.

According to the present invention, a method of manufacturing pulp using Rhodophyta is provided, the method comprising: immersing Rhodophyta in an extraction solvent able to dissolve agar gel for a predetermined time period to dissolve the agar gel in the extraction solvent; and pulping after collecting a pulp material remaining after removal of the solution containing the dissolved agar gel.

According to the present invention, a method of manufacturing pulp using Rhodophyta is provided, the method comprising: immersing Rhodophyta in an extraction solvent able to dissolve agar gel for a predetermined time period to dissolve a portion of the agar gel in the extraction solvent; collecting a pulp material remaining after removal of the solution containing the dissolved portion of agar gel; curing the chipped pulp material using a curing agent; and pulping the cured fiber.

In this case, dissolving the portion of agar gel in the extraction solvent may be performed by immersing Rhodophyta in an alcohol-based solvent; followed by boiling.

The curing agent may comprise aldehyde. Also, the curing agent may comprise Glyoxal.

Further, the extraction solvent may be preferably used at a temperature of 80° C. or higher. The extraction solvent may comprise any one selected from water, alcohols, and ketones.

It is preferable that the reaction solvent be used at a temperature of 80° C. or higher. The reaction solvent may comprise alcohols or ketones, provided that the reaction solvent is a different material from the extraction solvent.

The dissolution may be performed by chipping Rhodophyta, followed by immersion in the extraction solvent.

Rhodophyta may be selected from *Gelidium amansii, Gracilaria verrucosa, Cottonii, Spinosum*, and combinations thereof.

The present invention provides pulp manufactured using Rhodophyta according to the above mentioned method.

The present invention provides a method of manufacturing paper, comprising preparing pulp manufactured using Rhodophyta according to the above mentioned method, and manufacturing paper using the pulp. The present invention provides paper manufactured according to this method.

The present invention provides a method of manufacturing paper, comprising preparing pulp manufactured using Rhodophyta according to the above mentioned methods, preparing wood pulp, mixing two or more of the above pulps, and manufacturing paper using the pulp mixture. The present invention provides paper manufactured according to this method.

Best Mode

Hereinafter, a detailed description will be given of the present invention.

Pulp and Paper Material: Rhodophyta

Unlike other seaweeds, the 4000 species of Rhodophyta live in relatively deep water and have small sizes. Rhodophyta have a wider habitat range than *Chlorophyta* and *Phaeophyta*, and grow naturally from shallow water to water as deep as light rays penetrate.

Agar is a product processed by extracting heteropolysaccharide as a cell wall component of Rhodophyta with hot water, followed by freezing, melting and drying. An agar material can be derived from *Gelidium amansii, Pterocladia tenuis, Acanthopeltis japonica, Gracilaria verrucosa, Hypnea charoides, Ceramium kondoi, Ceramium boydenii, Gigartin tenella, Campylaephora hypnaeoides* and *Grateloupia filicina*. Although the agar has various properties according to the species, habitat environments and manufacturing methods of agarphyte which is raw seaweed thereof, it consists mainly of agarose and agaropectin mixed at a ratio of 7:3. These components are an effective component of the agar. Neutral polysaccharide agarose having high gelling properties is used to provide high strength, while acidic polysaccharide agaropectin having low gelling properties serves to provide high viscoelasticity. The agar is composed of 13-24% water, 70-85% non-nitrogen material (carbohydrate), 1.5-3.0% crude protein, 0.2-0.3% ether extract, and 0.5-0.8% crude fiber and 1-3% ash component. The dried agar product absorbs 20 times its weight of water.

Representative properties of the agar include coagulability, viscoelasticity and water retentivity. Since the agar has the opposite properties, that is, coagulability and viscoelasticity, it is applicable as a stabilizer, a weighting agent, a forming agent, a thickening agent, a drying inhibitor and a property-maintaining agent by controlling the above two properties.

An aqueous agar solution exhibits gelling properties higher than those of other gel-forming agents. The aqueous agar solution forms gel at 32-43° C., such that the formed gel does not dissolve at a temperature of 80-85° C. or lower. Even though gelling and dissolution are repeatedly performed, original agar gel properties are not changed. Transparent agar gel is easily colored, and increases in refractive index and gloss when mixed with sugar, glucose and glycerin.

Carrageenan, which is a water-soluble polymer polysaccharide extracted from seaweeds such as the genus *Chodrus* and *Euceuma* belonging to Rhodophyta, is produced into three types, such as kappa-, lambda- and iota-, having different properties from one another, and the types thereof are selected or properly mixed according to required purposes. Carrageenan generally used as a thickener has the ability to form gel in water, in which the resulting gel is highly thermoreversible. Hence, the above material is used as a gelling agent for dessert jelly, jam, tea, aromatic agents or deodorizing agents.

A yield of agar per dried weight of agarphyte unit amounts to about 60-80%, which is similar to or higher than that of pulp extracted from wood.

Therefore, as the pulp and paper material of the present invention, various Rhodophyta, including *Gelidium amansii, Gracilaria verrucosa, Cottonii*, and *Spinosum*, are used. Alternatively, carrageenan or agar obtained from Rhodophyta maybe used.

The agar hydrothermally extracted from *Gelidium amansii* or *Gracilaria verrucosa* has higher strength than that of carrageenan hydrothermally extracted from *Cottonii* or *Spinosum*. In particular, the agar component hydrothermally extracted from *Gracilaria verrucosa* is higher in strength, compared to agar hydrothermally extracted from *Gelidium amansii*.

Carrageenan belonging to Rhodophyta such as *Cottonii* and *Spinosum* has the same properties as the gel component contained in Rhodophyta such as *Gelidium amansii* and *Gracilaria verrucosa*, in view of including a fibrous material usable for manufacturing pulp. Therefore, in the present invention, carrageenan belonging to Rhodophyta such as *Cottonii* and *Spinosum*, along with the agar component contained in Rhodophyta such as *Gelidium amansii* and *Gracilaria verrucosa*, goes by the name of 'agar gel'.

Pulp Manufacturing

According to the present invention, pulp is manufactured using Rhodophyta as follows.

Rhodophyta such as *Gracilaria verrucosa, Gelidium amansii, Cottonii* or *Spinosum* are immersed in an alkali aqueous solution of potassium hydroxide (KOH) for a predetermined time period, and washed with water, followed by being partially dried. Here, through the immersion process of Rhodophyta in the alkali aqueous solution for a predetermined time period, Rhodophyta are slightly decolored while impurities are removed therefrom, and water content is constantly maintained. If Rhodophyta are not decolored, it is difficult to perform a subsequent bleaching process. Further, if Rhodophyta are completely dried, the fibrous material thereof is broken upon chipping through a beating process. Hence, upon processing Rhodophyta, the immersion of Rhodophyta in the alkali aqueous solution is commonly required. Techniques of immersing Rhodophyta in the alkali aqueous solution are well known in the art related to processing Rhodophyta, and hence, a description therefor is omitted.

The washed and semi-dried Rhodophyta are immersed in an extraction solvent. Thereby, the agar gel in Rhodophyta is extracted into the extraction solvent. The extraction solvent used for extracting the agar gel is exemplified by water, alcohols, such as ethyl alcohol or methyl alcohol, and ketones, such as acetone. As the extraction solvent any material may be used so long as it is able to dissolve the agar gel. Further, since the agar gel has a melting point of about 80° C., the extraction solvent should be a solvent capable of being heated to 80° C. or higher.

Here, as the area of Rhodophyta in contact with the extraction solvent increases, the agar gel is easily extracted. Thus, it is preferable that Rhodophyta be chipped before being immersed in the extraction solvent. The chipped fiber size of Rhodophyta may vary according to the selection of the user.

The gel solution containing the dissolved agar gel is added to a reaction solvent, whereby the agar gel is converted into fibrous material usable as pulp. At this time, the gel solution may be added in various ways, as shown in the appended drawings.

FIG. 1 shows the maimer of adding the gel solution to the reaction solvent using an extrusion nozzle.

As shown in FIG. 1, a gel solution 200 is extruded in a long string form and then added to a large amount of a reaction solvent 100 using a device such as an extrusion nozzle 210, so that the reaction sufficiently takes place in the reaction solvent 100.

In this way, the use of a relatively simple device, such as the extrusion nozzle 210, results in the conversion of the agar gel into the fibrous material.

Figure 2:
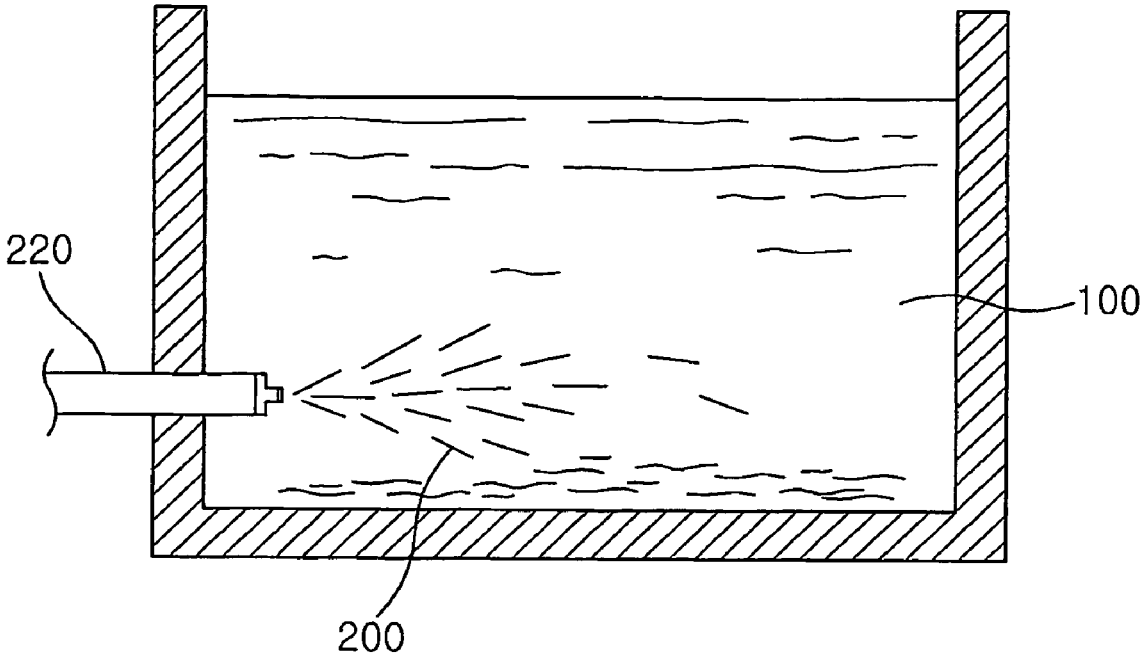
FIG. 2 is a view showing a process of adding a gel solution to a reaction solvent using a spray nozzle.

FIG. 2 shows the manner of adding the gel solution to the reaction solvent using a spray nozzle.

In cases of further increasing the reactivity of the gel solution and the reaction solvent, a gel solution 200 can be sprayed into a large amount of reaction solvent 100 using a spray nozzle 220, as shown in FIG. 2. In this case, it is preferable that the gel solution 200 be intermittently sprayed to provide an adequate time period to convert the agar gel into the fibrous material.

When the gel solution 200 is sprayed through the spray nozzle, it is added to the reaction solvent 100 in a thinner form, compared to the extrusion manner using the extrusion nozzle 210. Thereby, thinner fibrous material results.

The reaction solvent includes alcohols or ketones. Any liquid, in addition to alcohols and ketones, may be used so long as the agar gel may be converted into the fibrous material usable as pulp. However, if the reaction solvent contains the same composition as the extraction solvent, the agar gel is dissolved in the reaction solvent, instead of being converted into fibrous material usable as pulp. Therefore, it is noted that the composition of the reaction solvent is different from the extraction solvent When the gel solution is reacted with the reaction solvent, the reaction solvent is preferably heated to 80° C. or higher so that the agar gel is not cured.

However, the fibrous material resulting from the above process is much lower in strength, heat resistance and chemical resistance which are properties required to manufacture paper. Accordingly, the fibrous material should be cured using an aldehyde-based curing agent, such as Glyoxal. The cured fibrous material is chipped into a size suitable for papermaking, followed by pulping. This pulping process is the same as the process after the fiber has been obtained in a conventional wood pulping process, and hence, a description therefor is omitted. Since the cured fibrous material does not change the composition thereof even though it is heated to a high temperature or comes into contact with other solvents during the papermaking, it can be used as pulp.

Moreover, selection of Rhodophyta is not limited to one specific type. That is, various types of Rhodophyta may be mixed together. For example, two or more selected from *Gelidium amansii, Gracilaria verrucosa, Cottonii* and *Spinosum* are mixed together. In particular, the addition of *Gracilaria verrucosa*, functioning to increase binding force, results in a final product having high strength. Accordingly, to obtain paper having high strength, *Gracilaria verrucosa* is used in a large amount.

The present applicant has manufactured paper using Rhodophyta by the following process. A detailed description will be given of the papermaking process, below.

5 g of agar derived from *Gelidium amansii* and 5 g of agar derived from *Gracilaria verrucosa* are introduced into 500 cc of water, and then stirred for 5 min while the temperature is maintained in the range from 90° C. to less than a boiling point. Then, a curing process is performed using a curing agent, such as Glyoxal. After completion of the curing process, the cured material is subjected to beating and is then mixed with 5 g (1 wt %) of a sizing agent which results from gumming an admixture of a pine resin (rosin), heated to 150° C. and dissolved, and 20% aqueous sodium hydroxide solution in equal amounts. Subsequently, the resultant reaction material is mixed with 2.5 g (0.5 wt %) of Alum and then stirred so that strong alkalinity of sodium hydroxide is neutralized for efficient reaction of the agar solution and the rosin gum. 8 g (1.6 wt %) of starch as a dry strength agent is added to the reaction mixture and then the mixture is stirred for uniform mixing. Thereafter, a sheet forming process leads to manufacturing transparent paper, provided that the temperature is continuously maintained in the range from 90° C. to less than a boiling point just until performing the sheet forming process. The above paper is mixed with 25 g (5 wt %) of calcium carbonate as a loading agent and stirred, followed by sheet forming, thus obtaining opaque white paper.

In addition, when extracting the agar gel from Rhodophyta and pulping it, the pulp material remaining after the agar gel has been extracted has similar properties to the mechanical pulp of wood, and thus, may be used as pulp without additional treatment. To exhibit higher strength, the pulping process may be performed after the curing treatment, according to the selection of the user. At this time, the pulping process may include a process of chipping the pulp into a size suitable for papermaking.

In addition, in cases where chipped Rhodophyta are boiled at about 78° C. for 4 hours under atmospheric pressure using ethyl alcohol as the extraction solvent suitable for extracting the agar gel from Rhodophyta, only a portion of agar gel is extracted from Rhodophyta. Here, slight decoloration occurs while the portion of agar gel is extracted. Since the pulp material remaining after the portion of agar gel has been extracted contains the other portion of agar gel, the strength of the remaining pulp material is high. The remaining pulp material containing some agar gel is cured for pulping. To further increase the strength of the remaining pulp material, the pulp material remaining after the agar gel has been extracted is cured in the same manner as in the curing process of the fibrous material produced from the agar gel. The resulting pulp is further suitable for use in paper pulp. As mentioned above, the pulping process may include the process of chipping the pulp into the size suitable for papermaking.

The obtained pulp may be manufactured into the paper according to a general papermaking process.

As for the papermaking, the paper made using the pulp resulting from the agar gel has properties like paper made from chemical wood pulp, whereas the paper made using pulp obtained from the remaining pulp material has properties like paper made from mechanical wood pulp. Further, the paper manufactured using the pulp obtained from the remaining material has higher strength than that of the paper manufactured using the pulp resulting from the agar gel. Therefore, the pulp obtained from the agar gel, the pulp obtained from the remaining pulp material, and the pulp obtained from the remaining pulp material containing some agar gel, are mixed at various ratios, according to the selection of the user.

Moreover, a predetermined amount of wood pulp (mechanical pulp and/or chemical pulp) may be additionally included upon papermaking using Rhodophyta. In this way, addition of the wood pulp results in drastically increased paper strength and a smooth paper surface.

Papermaking Process

In general, 'paper' means a sheet formed of cellulose fibers of network structure suitable for use in printing, writing and packaging, and 'papermaking' means the process of manufacturing the paper adequate for desired use purposes through various treatments. Although the process of manufacturing the paper, that is, the papermaking process, slightly varies according to the use purposes of the end product paper, it is commonly performed as follows.

(1) Beating

When pulp manufactured in pulp factories is used for papermaking without any process, the resultant paper has drawbacks, such as low strength, a rough surface and very high air-permeability, and thus is difficult to be generally used. This is because natural pulp fibers are hard and have a low surface area, and therefore do not bind together.

Accordingly, the fiber is mechanically treated in water to be suitable for sheet forming. This process is referred to as beating, which is classified into free beating which cuts the fiber and wet beating causing fibrillation. The beating process results in removal of an outer layer of the fiber, internal fibrillation, longitudinal cutting of the fiber, the formation of fine fiber, and partial dissolution of a chemical composition. The beating process functions to soften the fiber so as to increase the binding of fibers. Thus, the higher the degree of beating, the denser the paper.

(2) Sizing

This process acts to provide resistance to the permeation of ink or water into the paper. Here, the usable reagent is referred to as a sizing agent. The sizing process is classified into surface sizing and internal sizing.

(3) Loading

This process serves to mix the pulp and a mineral material, such as clay or calcium carbonate, upon sheet forming, thereby increasing the opacity, printability and basis weight of paper.

(4) Sorting and Cleaning

These processes function to remove impurities from the paper material so that the resulting paper has uniform properties, before the paper material is fed into a paper machine.

(5) Sheet Forming

This process functions to form a web on a wire using the paper material composed of a mixture of the pulp, the sizing agent, the loading agent, and various additives, followed by compression, dehydration and drying, to obtain the paper. According to the formation manners of the web on the wire, the paper machine is classified into a fourdrinier machine, a cylinder machine, and a twin wire machine.

(6) Processing

This process is used to subject the manufactured paper to various processing treatments, such as coating, denaturation, absorption and layering In the papermaking method according to the present invention, Rhodophyta rather than wood pulp is used as a pulp and paper material. Thus, although the beating process is not indispensably performed, it may be preferably performed upon using agarphyte. If an agar product having high purity is used, the beating process is not required. Further, the steps (2) to (6) may be selectively carried out.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

INDUSTRIAL APPLICABILITY

As described above, the present invention provides pulp and paper made from Rhodophyta and a method of manufacturing the same. When the manufacturing method of the pulp of the present invention is applied, the following advantages can be expected:

Compared to wood, Rhodophyta is remarkably inexpensive purchased.

Compared to the wood pulp manufacturing process, when Rhodophyta is used, the use of chemicals for lignin removal and bleaching decreases drastically. Further, compared to the papermaking process using wood, a beating process is carried out at a low temperature, thus reducing energy usage. Since the beating process does not require a highly toxic chemical, environmental contamination deceases.

Since a minimally processed natural material is applied, it is spontaneously biodegraded with the passage of time. Hence, waste treatment becomes simple, and a waste treatment chemical is not used, thereby environmental contamination does not occur.

A final product does not contain a harmful chemical, and hence, humans and environments are not negatively affected.

Since Rhodophyta have adhesive, it is easy to process.

Since Rhodophyta does not have a lignin component, an additional process or a chemical treatment for removal of the above component is not required.

Moreover, the manufacturing method of the pulp according to the present invention is advantageous because the paper can be manufactured even without the use of wood, whereby various environmental problems, such as global warming, can be solved through forest conservation.

The invention claimed is:

1. A method of manufacturing pulp from Rhodophyta containing agar, comprising:

immersing Rhodophyta in an extraction solvent capable of dissolving agar for a predetermined time period sufficient to dissolve the agar in the extraction solvent;

converting the dissolved agar into a fiber by reacting the dissolved agar with a reaction solvent that is different from the extraction solvent;

curing the fiber with a curing agent that is an aldehyde to produce a cured fiber; and pulping the cured fiber to produce a pulp.

2. The method according to claim 1, wherein the conversion into the fiber is performed by continuously extruding the agar solution into the reaction solvent using an extrusion nozzle.

3. The method according to claim 1, wherein the conversion into the fiber is performed by intermittently extruding the agar solution into the reaction solvent using a spray nozzle.

4. A method of manufacturing pulp from Rhodophyta containing agar, comprising:

immersing Rhodophyta in an extraction solvent capable of dissolving agar for a predetermined time period sufficient to dissolve the agar in the extraction solvent thereby leaving a pulp material remaining after the agar is extracted from Rhodophyta;

collecting the pulp material by removing the extraction solvent; and pulping the pulp material to produce a pulp.

5. A method of manufacturing pulp from Rhodophyta containing agar, comprising:

immersing Rhodophyta in an extraction solvent capable of dissolving the agar for a predetermined time period sufficient to dissolve only a portion of the agar in the extraction solvent thereby leaving a pulp material including a remaining portion of agar remaining after the portion of the agar is extracted from Rhodophyta;

collecting the pulp material by removing the extraction solvents curing the pulp material with a curing agent that is an aldehyde; and pulping the cured pulp material to produce a pulp.

6. The method according to claim 5, wherein the dissolution of the portion of the agar in the extraction solvent is performed by immersing Rhodophyta in an alcohol-based solvent while boiling the alcohol-based solvent.

7. The method according to claims 1 or 5, wherein the curing agent comprises glyoxal.

8. The method according to claims 1, 4 or 5, wherein the extraction solvent is used at a temperature of 80° C. or higher.

9. The method according to claims 1, 4 or 5, wherein the extraction solvent comprises any one selected from water, alcohols, and ketones.

10. The method according claim 1, wherein the reaction solvent is used at a temperature of 80° C. or higher.

11. The method according to claim 10, wherein the reaction solvent comprises alcohols or ketones.

12. The method according to claims 1, 4 or 5, further comprising chipping Rhodophyta, followed by immersion in the extraction solvent.

13. The method according to claims 1, 4 or 5, wherein Rhodophyta is selected from *Gelidium amansii, Gradilaria vetrucosa, Cottonii, Spinosum*, and combinations thereof.

14. A pulp manufactured from Rhodophyta according to claims 1, 4 or 5.

15. A method of manufacturing paper, comprising:

preparing pulp manufactured using Rhodophyta according to claims 1, 4 or 5 and manufacturing paper using the pulp.

16. Paper manufactured according to claim 15.

17. A method of manufacturing paper, comprising:

preparing pulp manufactured using Rhodophyta according to claims 1, 4 or 5;

preparing wood pulp;

mixing the two pulps; and manufacturing paper using the pulp mixture obtained from the mixing step.

18. Paper manufactured according to claim 17.

* * * * *